US008770370B2

(12) United States Patent
Young

(10) Patent No.: US 8,770,370 B2
(45) Date of Patent: Jul. 8, 2014

(54) HANDLING OF DIFFERENT CLASSES OF CURRENCY

(75) Inventor: Neil M. Young, Dowingtown, PA (US)

(73) Assignee: MEI, Inc., Malvern, PA (US)

( * ) Notice: Subject to any disclaimer, the term of this patent is extended or adjusted under 35 U.S.C. 154(b) by 7 days.

(21) Appl. No.: 13/120,291

(22) PCT Filed: Sep. 23, 2009

(86) PCT No.: PCT/US2009/058007

§ 371 (c)(1),
(2), (4) Date: Jun. 3, 2011

(87) PCT Pub. No.: WO2010/036693

PCT Pub. Date: Apr. 1, 2010

(65) Prior Publication Data

US 2011/0259707 A1 Oct. 27, 2011

Related U.S. Application Data

(60) Provisional application No. 61/099,402, filed on Sep. 23, 2008.

(51) Int. Cl.
*G07F 7/00* (2006.01)

(52) U.S. Cl.
USPC ..... 194/205

(58) Field of Classification Search
USPC ..... 194/342, 205, 206, 207; 235/379; 209/534; 700/215, 225, 226
See application file for complete search history.

(56) References Cited

U.S. PATENT DOCUMENTS

| | | | | |
|---|---|---|---|---|
| 6,006,989 | A | 12/1999 | Ademmer et al. | |
| 6,371,473 | B1 * | 4/2002 | Saltsov et al. | 271/3.01 |
| 7,103,438 | B2 * | 9/2006 | Hallowell et al. | 700/116 |

FOREIGN PATENT DOCUMENTS

| | | | |
|---|---|---|---|
| EP | 881605 | A1 | 12/1998 |
| EP | 1291831 | A2 | 3/2003 |
| GB | 2244838 | A | 12/1991 |
| WO | WO2007101621 | A1 | 9/2007 |

* cited by examiner

*Primary Examiner* — Mark Beauchaine
(74) *Attorney, Agent, or Firm* — Mintz Levin Cohn Ferris Glovsky and Popeo, P.C.

(57) ABSTRACT

A money handling apparatus is arranged to receive items of currency and classify each into at least one class. Each class of currency items is stored and managed by the money handling apparatus in order to be able to extract the received items. In some implementations, the money handling apparatus is arranged to receive items of currency, store items of currency, receive at least one service media, and transport at least one stored currency item to a removable storage unit in a specified sequence or order.

15 Claims, 12 Drawing Sheets

60

100
200
110
120
21
40
30
40
22
40
60
40
70
40
55a
50
55b
10

HANDLING OF DIFFERENT CLASSES OF CURRENCY

CROSS REFERENCE TO RELATED APPLICATIONS

This application is a national phase filing under 35 U.S.C. §371 of International application number PCT/US2009/058007, filed Sep. 23, 2009, which claims priority from provisional application number 61/099,402 filed Sep. 23, 2008. The contents of the prior applications are incorporated herein by reference in their entirety.

FIELD OF DISCLOSURE

The disclosure relates to the handling of different classes of currency within a currency handling apparatus.

BACKGROUND

It is known to provide a machine to receive and dispense items of currency in response to user activity. In conventional automated teller machines, a banknote is received from a user, authenticated and stored within a cashbox. In other conventional ATMs, the machine is configured to temporarily store currency for later dispensing to a user as change in a transaction. In some conventional devices, the inserted currency may be stored in individual cashboxes or recycling containers according to denomination.

In each of the above examples inserted items deemed to be non-authentic or unable to be identified are typically returned to the user and considered to be "reject" items. In other conventional systems there may be a permanent storage container or cashbox in which all non-authentic and poor quality authentic inserted currency items are place for later removal.

SUMMARY

The disclosure relates to a money handling apparatus arranged to transport and store various items.

In one aspect, a money handling apparatus is arranged to receive items of currency and classify each into at least one class. Each class of currency items is stored and managed by the money handling apparatus in order to be able to extract the received items. In some implementations, the money handling apparatus is arranged to receive items of currency, store items of currency, receive at least one service media, and transport at least one stored currency item to a removable storage unit in a specified sequence or order.

Other aspects of the invention, and various features and advantages, will be readily apparent from the detailed description, the accompanying drawings, and the claims.

DETAILED DESCRIPTION

Figure 1:
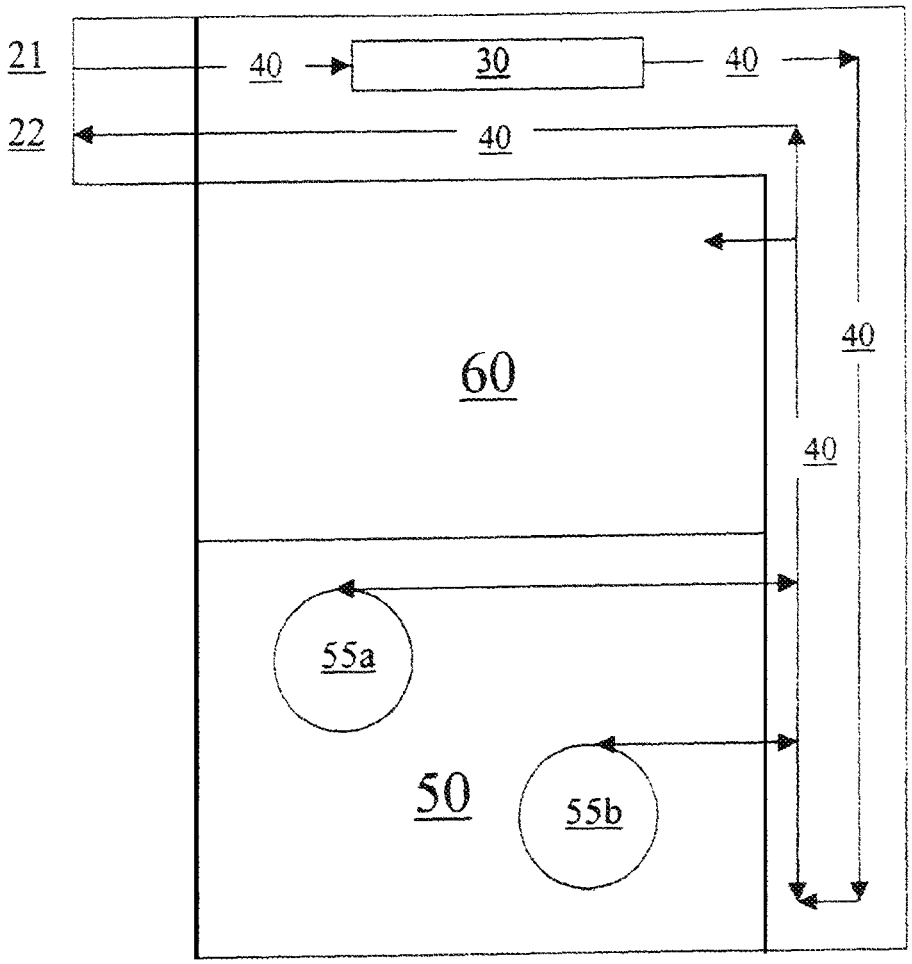
FIG. 1 illustrates an example of a money handling apparatus.
Figure 2:
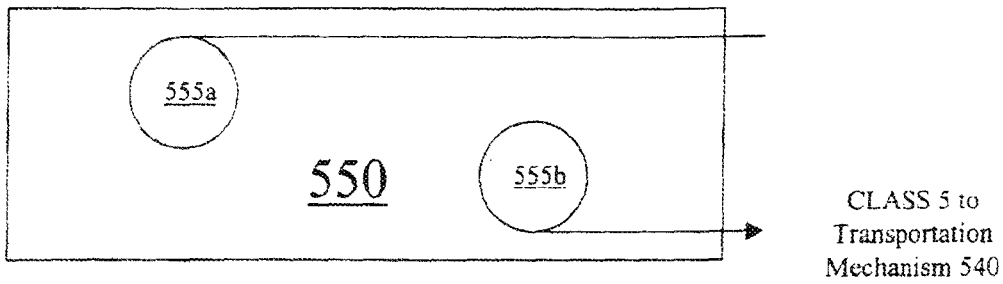
FIG. 2 illustrates items being dispensed from a currency storage unit including a first and second storage.
Figure 3:
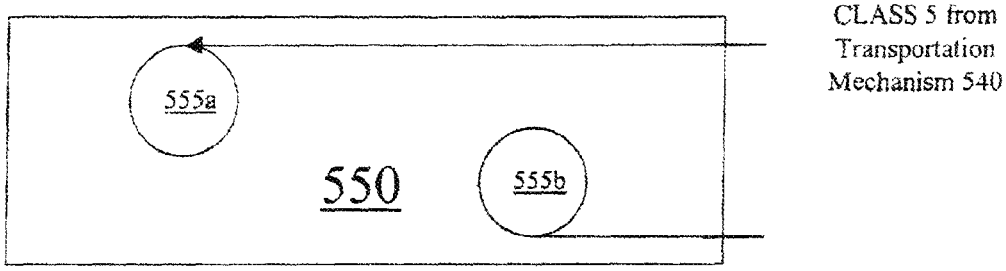
FIG. 3 illustrates items being received by the currency storage unit.
Figure 4:
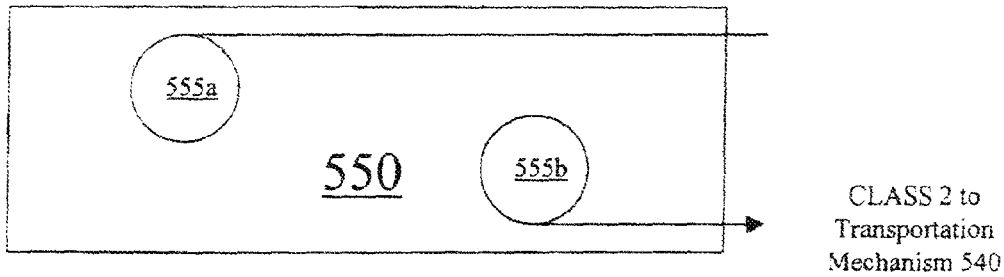
FIG. 4 illustrates items being dispensed from the currency storage unit.
Figure 5:
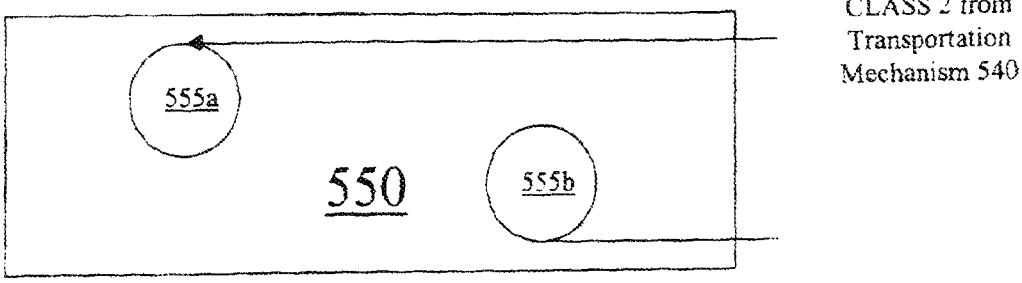
FIG. 5 illustrates items being received by the currency storage unit.
Figure 6:
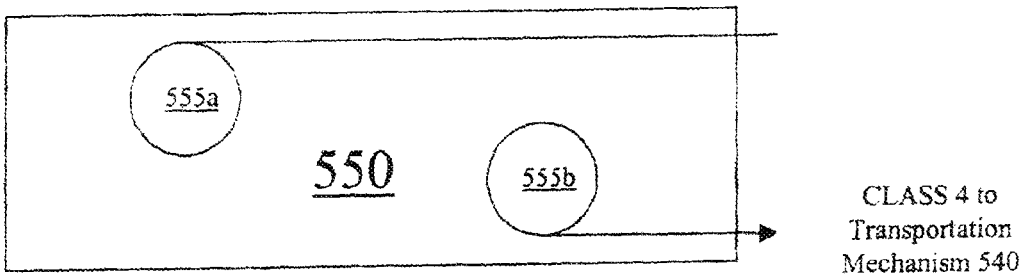
FIG. 6 illustrates items being dispensed from the currency storage unit.
Figure 7:
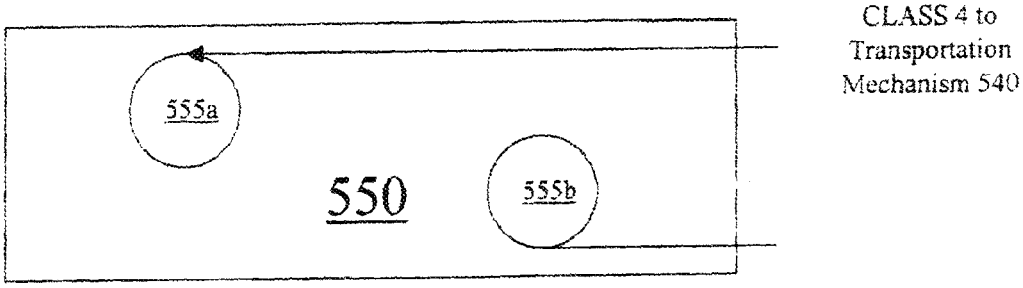
FIG. 7 illustrates items being received by the currency storage unit.
Figure 8:
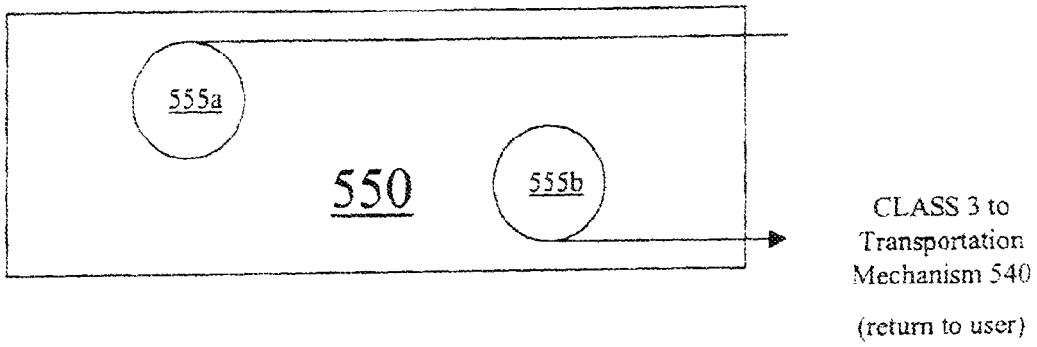
FIG. 8 illustrates items being dispensed from the currency storage unit.
Figure 9:
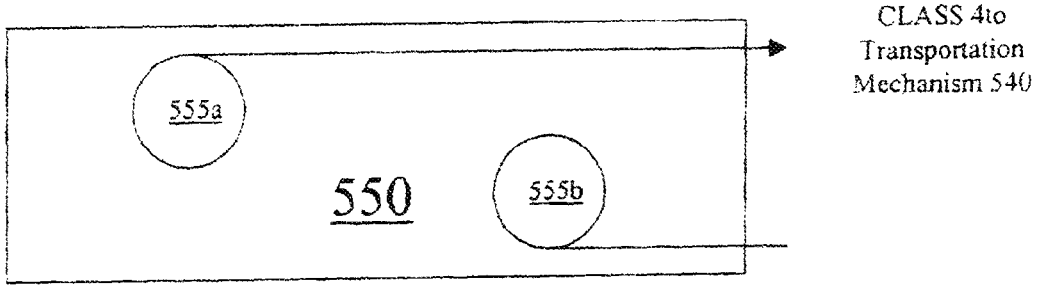
FIG. 9 illustrates items being dispensed from the currency storage unit.
Figure 10:
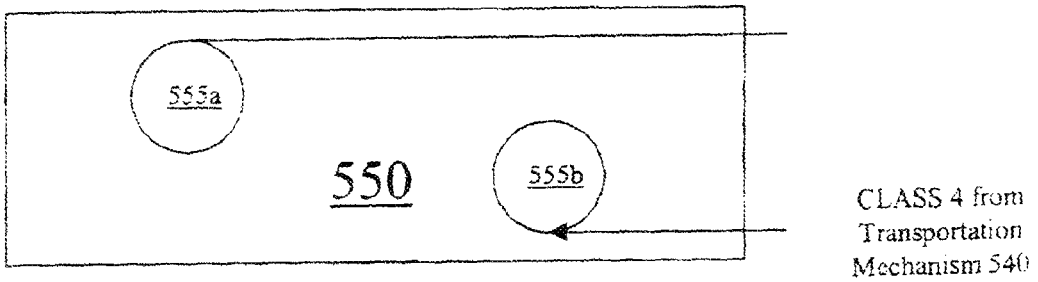
FIG. 10 illustrates items being received by the currency storage unit.
Figure 11:
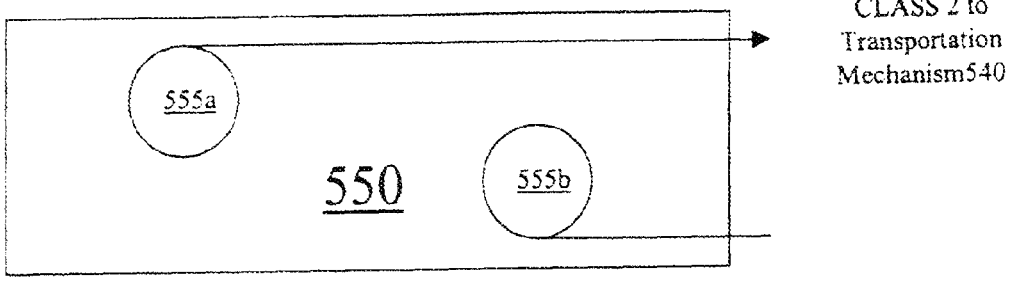
FIG. 11 illustrates items being dispensed from the currency storage unit.
Figure 12:
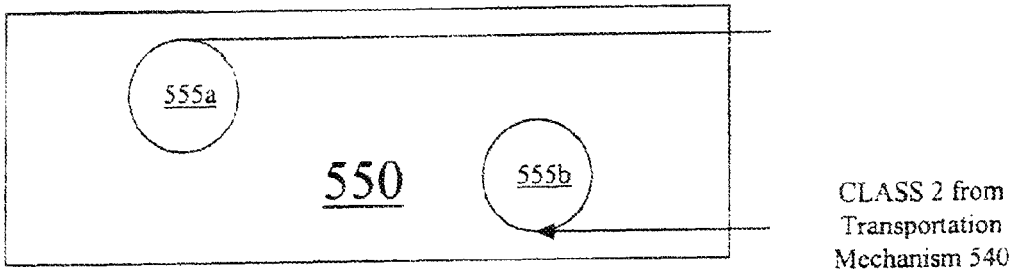
FIG. 12 illustrates items being received by the currency storage unit.
Figure 13:
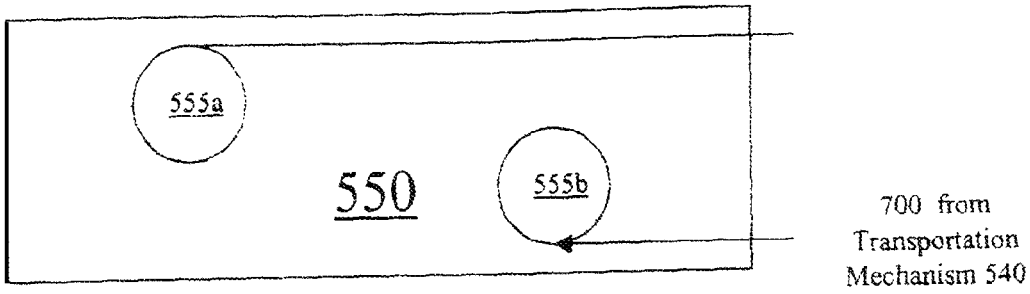
FIG. 13 illustrates a service coupon being received by the currency storage unit.
Figure 14:
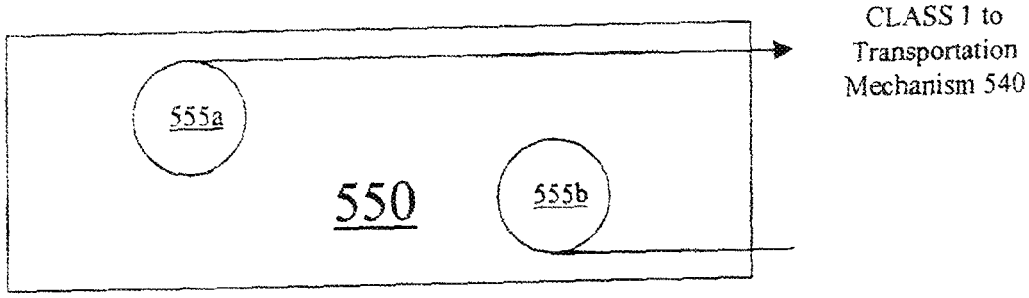
FIG. 14 illustrates items being dispensed from the currency storage unit.
Figure 15:
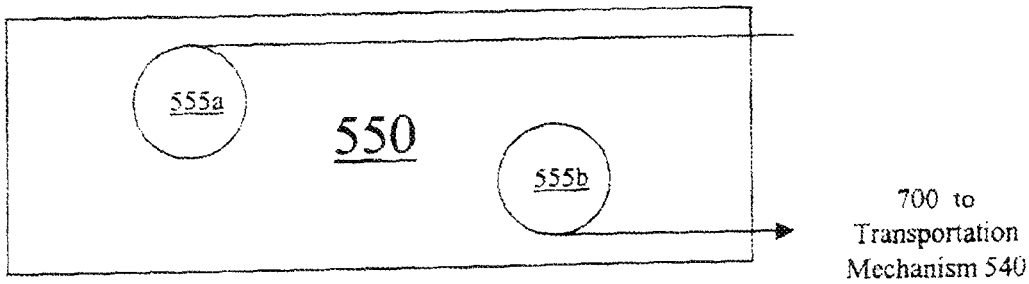
FIG. 15 illustrates a service coupon being dispensed from the currency storage unit.

As illustrated in FIG. 1, a money handling unit 10 is configured to receive items of currency (e.g., banknotes) from a user, an authorized individual, or a removable loading unit.

In the example of FIG. 1, the money handling unit 10 includes a currency inlet/out 20 for receiving banknote(s), an authentication unit 30 for authenticating banknotes, a transportation mechanism 40 for transporting banknotes to and from various components within the money handling machine 10, and multiple currency storage units 50 coupled to transportation mechanism 40 and arranged for receiving and dispensing items of currency. In some implementations, money handling unit 10 further includes a cashbox 60 for receiving and storing items of currency from transportation mechanism 40, and a loading unit 70 for providing at least one item of currency to the money handling unit 10 for use as change in a transaction.

Inlet/outlet 20 is coupled to transportation mechanism 40 such that banknotes inserted into inlet/outlet 20 are received by the transportation mechanism 40. Typically, inlet/outlet 20 is configured to accept a wide variety of banknotes having various widths. In some implementations, a banknote presence sensing system 23 is coupled to inlet/outlet 20 and configured for sensing the presence of the banknote(s) in the inlet/outlet opening.

Authentication unit 30 is coupled to transportation mechanism 40 and is arranged to validate and classify items of currency, for example, according to known techniques. In some implementations, authentication unit 30 uses an optical sensing unit to discriminate an item of currency (e.g., to discriminate between genuine vs. non-genuine items, or to classify the items) and determine other characteristics of the document (e.g., condition, degree of soiling, rips, tears, holes, etc.). The optical sensing unit can be of any type (e.g., spectral reflection and/transmission). Alternatively, the sensing unit can be any other type of currency sensing system (e.g., magnetic sensing, physical sensing). Authentication unit 30 can be configured to sense and discriminate items of currency or it can be arranged to provide sensed data to a control unit 100 for further processing.

Transportation mechanism 40 operatively couples inlet/outlet 20 to the authentication unit 30. Transportation mechanism 40 includes a series of belts driven by an actuator to cause banknotes to move in an inward and outward direction relative to the entry and exit of the money handling unit 10. In some implementations, transportation mechanism 40 includes one continuous transportation path arranged to move in forward or backward motion (or capable of moving in both the forward and backward directions). In other implementations, transportation mechanism 40 is comprised of a series of smaller transportation units to create a continuous transportation path. Other types of transportation mechanisms can be adapted for use within the money handling unit 10. Transportation mechanism 40 is further coupled to currency storage units 50 for transporting banknotes (i.e., items of currency) to and from the storage units based on the desired operation of money handling unit 10.

A currency storage unit 50 is mounted to money handling unit 10 and operatively coupled to transportation mechanism 40 for receiving and dispensing banknotes. In some implementations, currency storage unit 50 is removably mounted to money handling unit 10. Currency storage unit 50 is arranged to store banknotes sequentially on a storage drum 55 (i.e., two-way storage). In some implementations, currency storage unit 50 is arranged to store banknotes in a stacked (i.e., face to face) manner. Banknotes selected to be stored within storage unit 50 are received from transportation mechanism 40 for later user as change in a transaction. Banknotes stored within currency storage unit 50 can be dispensed therefrom to transportation mechanism 40 for further processing by money handling unit 10.

Money handling unit 10 further includes a control unit 100 for controlling the overall operation of the money handling unit. Control unit 100 includes a microprocessor 110 and memory 120 for processing and storing instructions to operate money handling unit 10. Control unit 100 is arranged to determine how each inserted banknote is handled (e.g., where it should be stored or whether it should be returned to the user), and for controlling any component (e.g., components 30, 40, 50, 60, 70) coupled thereto to accomplish movement of banknotes into, through and out of money handling unit 10.

In some implementations, control unit 100 includes an external access for communicating with an external component 200 (e.g., handheld service tool or remote computer). In other implementations, money handling unit 10 includes a communications unit 300 for communicating with remote devices for receiving updates and/or service information.

Cashbox 60 is removably mounted to money handling unit 10 and is arranged to receive banknotes from transportation mechanism 40. Cashbox 60 is configured to store banknotes identified by the money handling unit to be held within cashbox 60 for later removal by an authorized individual. Cashbox 60 is configured as a one-way storage device for currency items such that items contained in the cashbox cannot be extracted by money handling unit 10 and thus have to removed from the cashbox when it is external to the money handling unit.

Loading unit 70 is removably mounted to money handling unit 10 and operatively coupled to transportation mechanism 40. Loading unit 70 is arranged to have banknotes inserted therein at a location (e.g., banking center) remote from money handling unit 10. Loading unit 70 is configured to house either a single class of banknote (e.g., 5 euro) or multiple classes of banknotes (e.g., 5 euro, 10 euro, 20 euro) and supply its contents to money handling unit 10. Once loading unit 70 is inserted into money handling unit 10 by an authorized individual, control unit 100 can the instruct loading unit and transportation mechanism 40 to extract the contents of the loading unit. Each banknote dispensed from loading unit 70 is transported to authentication unit 30 to verify at least one of its validity, class or condition. Based on the results obtained from authentication unit 30, money handling unit 10 sends each banknote to a respective storage unit.

In some implementations, money handling unit 10 has separate openings for receiving and dispensing items of currency. For example, a currency inlet 21 is for receiving at least one item of currency from a user and currency outlet 22 is for dispensing at least one item of currency to a user.

In some implementations, inlet 21 and/or outlet 22 are arranged to handling a bundle of banknotes at one time. More specifically, a user may provide a stack of banknotes to money handling unit 10 via currency inlet 21. The stack of currency can be received by unit 10 where each banknote is feed by transportation mechanism 40 to authentication unit 30 one at a time.

Each banknote inserted through inlet 21 is fed to authentication unit 30 to determine at least one of its validity, class or condition. Each banknote inspected by authentication unit 30 is transported by transportation mechanism 40 to a respective two-way storage unit 50. In some implementations, each two-way storage unit 50 contains two individual currency recycling drums 55. Each recycling drum 55 is configured to store and dispense banknotes sequentially. In some implementations each recycling drum 55 is arranged to store a single class of banknote (e.g., 5 euro banknotes). However, in some cases, the drums are arranged to store a mix of banknote classes (e.g., 5 euro and 20 euro banknotes).

In some implementations, money handling unit 10 is configured to include multiple storage units 50. Each storage unit 50 can be configured to store a different class (e.g., denomination or characterization) of currency. In implementations in which each storage unit 50 includes more than one storage drum 55, each storage drum can be configured to store a specific class of currency as instructed by money handling unit 10.

In operation, a user inserts at least one item of currency (e.g., banknote) into inlet 22. As the banknote moves into inlet 22, sensing system 23 senses the presence of a banknote thereby initiating transportation mechanism 40 to feed the banknote (and any subsequent banknotes, for example from a bundle) to authentication unit 30. Sensed data obtained from authentication unit 30 allows for classification of each banknote into one of multiple classes based on the programmed operation of money handling unit 10. For example, money handling unit 10 can classify an inserted item of currency as a valid banknote of a known denomination (e.g., 5 euro), a valid banknote of a known denomination in poor condition (e.g., not fit for circulation), a suspected counterfeit banknote (i.e., a copy), not a banknote, or a soiled or damaged banknote. Money handling unit 10 is configured to store or reject each item of currency class based on instructions stored within control unit 100.

Once an individual banknote is classified by money handling unit 10, it is transported by transportation mechanism 40 to the respective currency storage unit 50 for that class. Once all the inserted banknotes from the user have been identified by authentication unit 30, and transported to their respective currency storage units 50, money handling unit 10 will return inserted items not selected for storage within the money handling unit 10 to the user through outlet 22. If there is more than one item to be returned to the user that is not a valid item of currency, money handling unit 10 can be arranged so that the currency items are returned either in a bundle or in sequential fashion through outlet 22.

In some implementations, change may need to be given for a transaction being conducted with the user. In that case, money handling unit 10 will dispense the appropriate combination of banknotes to the user based on instructions from control unit 100.

In some implementations, there is a specific currency storage unit 50 for storing at least one of the inserted items classified as suspected counterfeit banknotes, suspect banknotes not clearly identified, and reject items. In this example, a currency storage unit 50 (e.g., having two storage drums 55) manages the receipt of suspect banknotes (i.e., both counterfeit and not clear identifiable) and rejected items. A first drum 55*a* is designated for storing suspect banknotes and a second drum 55*b* is designated for storing reject items. As inserted items of currency are processed by money handling unit 10, each item is transported to a respective storage unit 50 as instructed by control unit 100.

Figure 21:
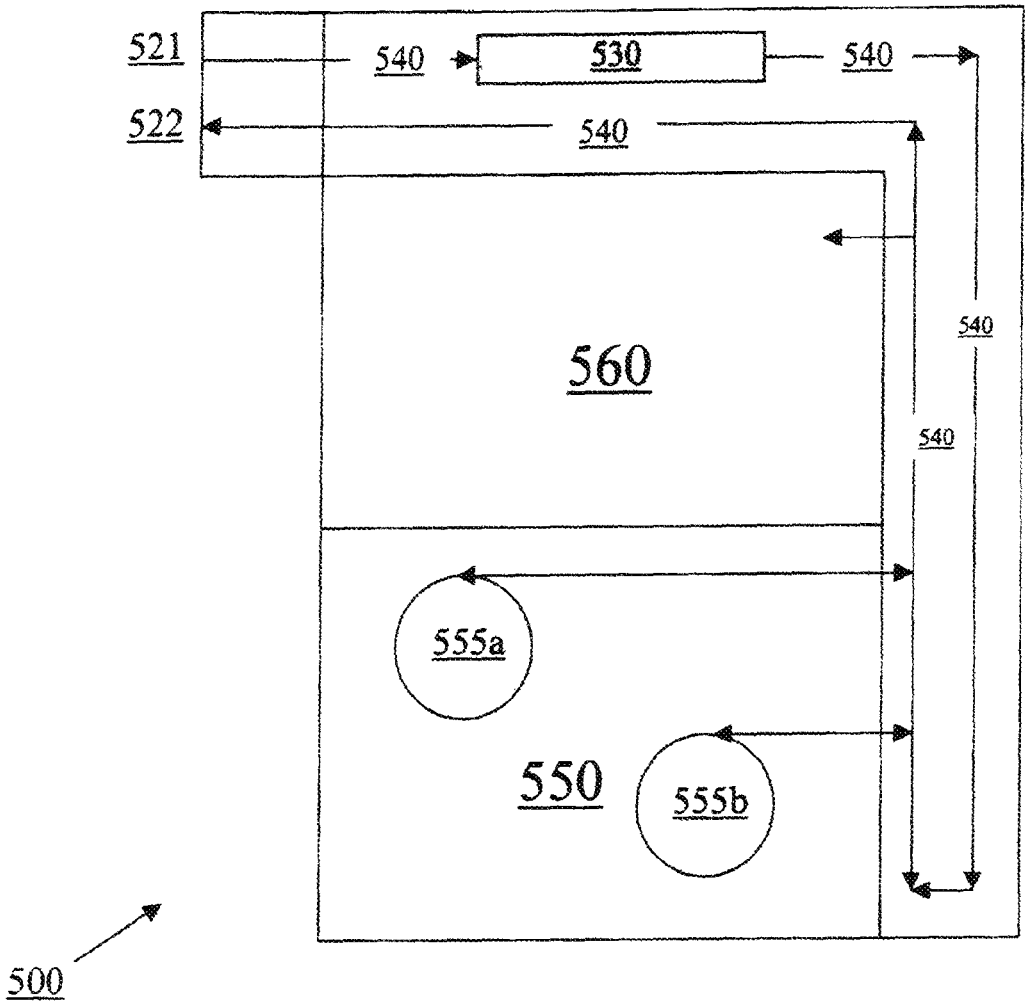
FIG. 21 illustrates an example of a money handling apparatus.

FIG. 21 shows a simplified example for purposes of illustration. Money handling device 500 includes an inlet 521 for receiving at least one banknote from a user, an authentication unit 530, a two-way storage unit 550 (including a first storage drum 555*a* and second storage drum 555*b*) for storing inserted items of currency, a single path transportation unit 540 for transporting inserted notes to and from storage unit 550, and an outlet 522 for dispensing items of currency to the user. For simplicity, the operation of the illustrated device 500 is described using a single currency denomination (e.g., 5 euro), although the disclosure is not limited to such a configuration (see FIGS. 2 thru 11).

In operation, a user inserts, for example, a bundle of twenty 5-euro documents at inlet 521. Transportation mechanism 540 feeds each of the twenty 5-euro banknotes from inlet 521 sequentially, one at a time, to authentication unit 530. Authentication unit 530 senses each banknote and classifies it into one of the following classes:

TABLE 1

| banknote classes (for the example of FIG. 21): |
|---|
| 1) Valid 5-Euro fit for circulation |
| 2) Valid 5-Euro unfit for circulation |
| 3) Not a 5-Euro banknote |
| 4) Suspected counterfeit 5-Euro banknote |
| 5) Soiled or damaged 5-Euro banknote |

In the foregoing example, the classes listed in Table 1 can be split further into two main groups. Group A includes item 1 from Table 1, and Group B includes items 2 thru 5 from Table 1. With respect to the money handling device 500 (FIG. 21), Group A items are stored on first drum 555*a* and Group B items are stored on drum 555*b*. To further explain the example, it is assumed that the results from authentication unit 530 for each of the 20 banknotes inserted by the user are characterized as shown in Table 2.

TABLE 2

| Sample classification of the twenty banknotes: | |
|---|---|
| 1 | CLASS 1 |
| 2 | CLASS 1 |

TABLE 2-continued

| Sample classification of the twenty banknotes: | |
|---|---|
| 3 | CLASS 1 |
| 4 | CLASS 1 |
| 5 | CLASS 3 |
| 6 | CLASS 1 |
| 7 | CLASS 1 |
| 8 | CLASS 1 |
| 9 | CLASS 1 |
| 10 | CLASS 4 |
| 11 | CLASS 1 |
| 12 | CLASS 1 |
| 13 | CLASS 1 |
| 14 | CLASS 1 |
| 15 | CLASS 2 |
| 16 | CLASS 1 |
| 17 | CLASS 1 |
| 18 | CLASS 1 |
| 19 | CLASS 1 |
| 20 | CLASS 5 |

Based on the classification for each of the twenty banknotes listed in Table 2, the following banknotes are stored on first drum 555*a*: notes 1-4, 6-9, 11-14 and 16-19. Additionally, the following banknotes are stored on second drum 555*b*: notes 5, 10, 15 and 20.

In some implementations, inserted items classified as CLASS 3 items are to be returned to the user. In the current example implementation, the first item stored on drum 555*b* is a CLASS 3 item and, therefore, must be returned to the user. In order to accomplish this, the three other notes stored on drum 555*b* (for example) must be moved off drum 555*b* so that the CLASS 3 note can be received by transportation mechanism 540 and thus returned to the user via outlet 522. In the current example, this can be accomplished by reversing drum 555*b* in a direction opposite that used for receiving items so that the first note available to be dispensed (i.e., the CLASS 5 note) can be sent to transportation mechanism 540. Once this note is received by transportation mechanism 540, it is transferred temporarily to first drum 555*a*. Each of the notes on drum 555*b* that is to be separated from CLASS 1 notes, and that is not a CLASS 3 note, can be stored temporarily on drum 555*a* so that the CLASS 3 note(s) can be dispensed from drum 555*b* to transportation mechanism 540 and thus returned to the user via outlet 522. Once the CLASS 3 note is dispensed from second drum 555*b*, any notes stored temporarily on first drum 555*a* can be returned to second drum 555*b* via transportation mechanism 540. The foregoing is simply an example of a particular implementation. Other examples are within the scope of the disclosure.

Money handling unit 10 can be arranged with additional currency storage units 50 such that each class of currency items listed in Table 1 is stored within a dedicated currency storage unit 50. Also, each class of currency items listed in Table 1 can be stored in a dedicated storage drum 55 within a respective currency storage unit 50.

In some implementations, money handling unit 10 is arranged to store acceptance or characterization information for various items of currency. For example, for each item of currency in which money handling unit 10 is configured to accept, a sensing profile (e.g., spectral response, magnetic response) complimentary to the type of sensing unit employed can be used to classify and inserted item according to known techniques.

In some implementations, there are specific coupons or separating cards that can be accepted by money handling unit 10 so that the money handling unit 10 operates in a specified manner. Specifically, an authorized person (e.g., service operator) can insert unique an operator card or coupon into money handling unit 10 to cause a complementary class of currency items to be transported and deposited into cashbox 60. Under certain conditions, a service person may need to extract currency items stored within money handling unit 10. To accomplish this, the service person would insert a unique service coupon to request money handling unit 10 to deposit the corresponding currency item into cashbox 60. For example, there can be a unique service card for each class, or any identified class recognized by money handling unit 10.

The operation for extracting at least one class of currency from money handling apparatus 10 is now described. A service person requiring the removal of at least one class of currency items stored within money handling unit 10 inserts one or more corresponding coupons (or service tickets) that cause the money handling unit to deposit sequentially all currency items of that class corresponding to the inserted coupon into cashbox 60. If it is desired to have any additional classes of currency items transferred to cashbox 60, the service person instructs money handling unit 10 to have the next desired class of currency to be deposited sequentially in cashbox 60. In various implementations, the service person can interact with money handling unit 10 directly or remotely. In some implementations, the service person interacts with money handling unit 10 via service media (e.g., a service coupon, a connected handheld device, a wireless communication device or a computer). The operation of inserting a service coupon into money handling unit 10 can be repeated as many times as necessary, depending on whether there are different classes of currency items required to be removed from the money handling unit.

By way of example, money handling device 500 includes a currency storage unit 50 having first and second drums 555*a* and 555*b*, and a cashbox 560 as described in the previous example. The service operator inserts service coupon 700 corresponding to CLASS 1 currency items. Upon inserting service coupon 700 into inlet 521, transportation mechanism 40 is actuated to transport the service coupon to authentication unit 530. Authentication unit 530 recognizes (e.g., via spectral response) the inserted item as service coupon 700, enabling money handling device 500 to execute operational instructions to have all CLASS 1 currency items dispensed to cashbox 560 via transportation mechanism 540. In order to transfer all CLASS 1 documents to cashbox 560, service coupon 700 is stored temporarily on storage drum 555*b* (i.e., where CLASS 1 currency items are not stored). Once service coupon 700 is stored temporarily on storage drum 555*b*, the money handling device operates to cause CLASS 1 currency items to be dispensed from storage drum 555*a* to cashbox 560 via transportation mechanism 540. Once all CLASS 1 currency items have been transferred to cashbox 560, service coupon 700 is dispensed from storage drum 555*b* to cashbox 560 via transportation mechanism 540.

If it is desired to have CLASS 2 currency items transferred into cashbox 560, the service person inserts a service coupon 800 corresponding to CLASS 2 currency items into money handling device 500. Once service coupon 800 is inserted into inlet 521, transportation mechanism 540 transports the service coupon to authentication unit 530. Authentication unit 530 recognizes (e.g., via spectral response) the inserted item as service coupon 800, enabling money handling device 500 to execute operational instructions to have all CLASS 2 currency items dispensed to cashbox 560 via transportation mechanism 540. In order to transfer all CLASS 2 documents to cashbox 560, service coupon 800 is stored temporarily on storage drum 555*a* (i.e., where CLASS 2 currency items are not stored).

Figure 16:
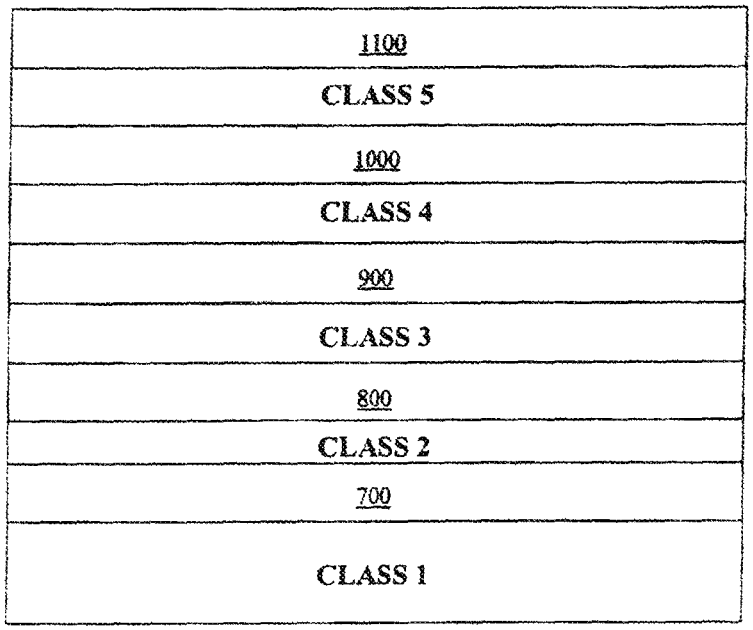
FIG. 16 illustrates various classes of items having been arranged within the removable storage cassette in a predetermined sequence.
Figure 17:
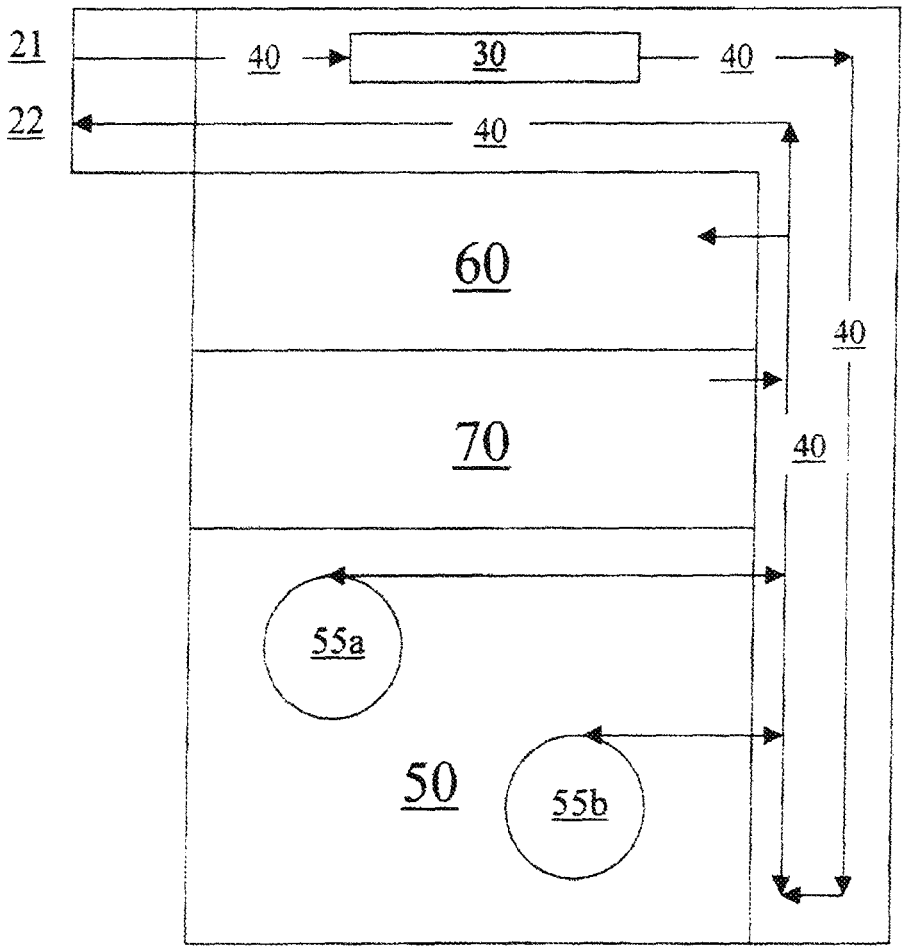
FIG. 17 illustrates a money handling apparatus including a removable loader.
Figure 18:
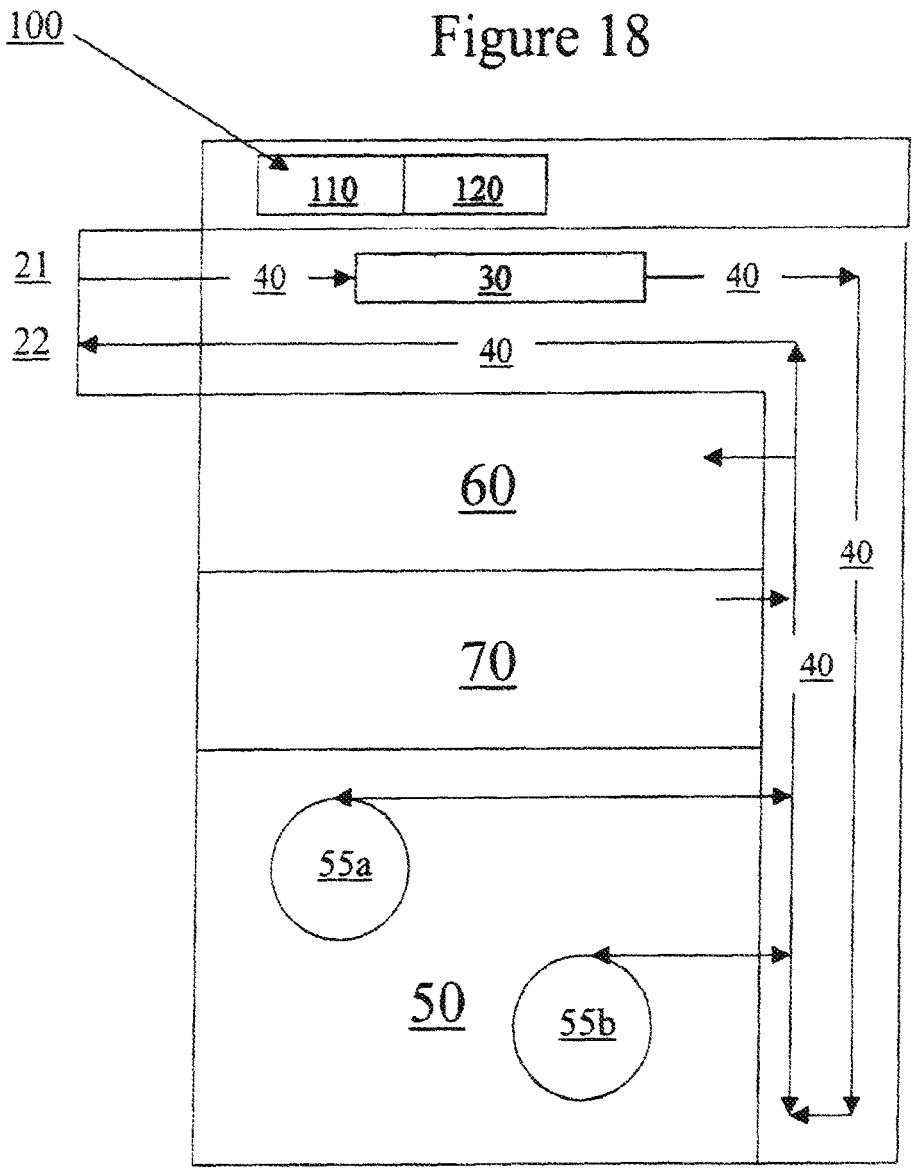
FIG. 18 illustrates a money handling apparatus including a control unit.
Figure 19:
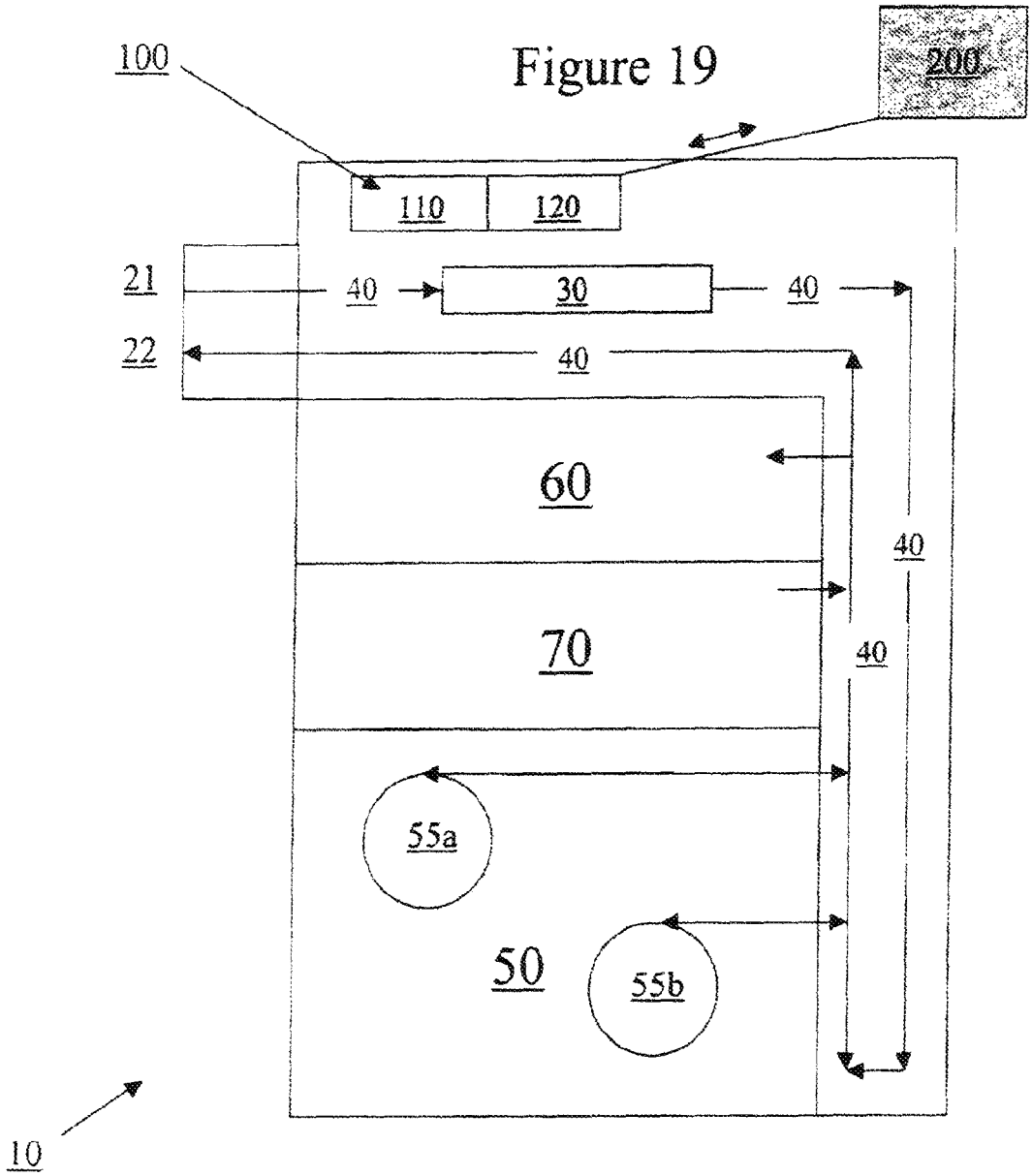
FIG. 19 illustrates a money handling apparatus including an external component.
Figure 20:
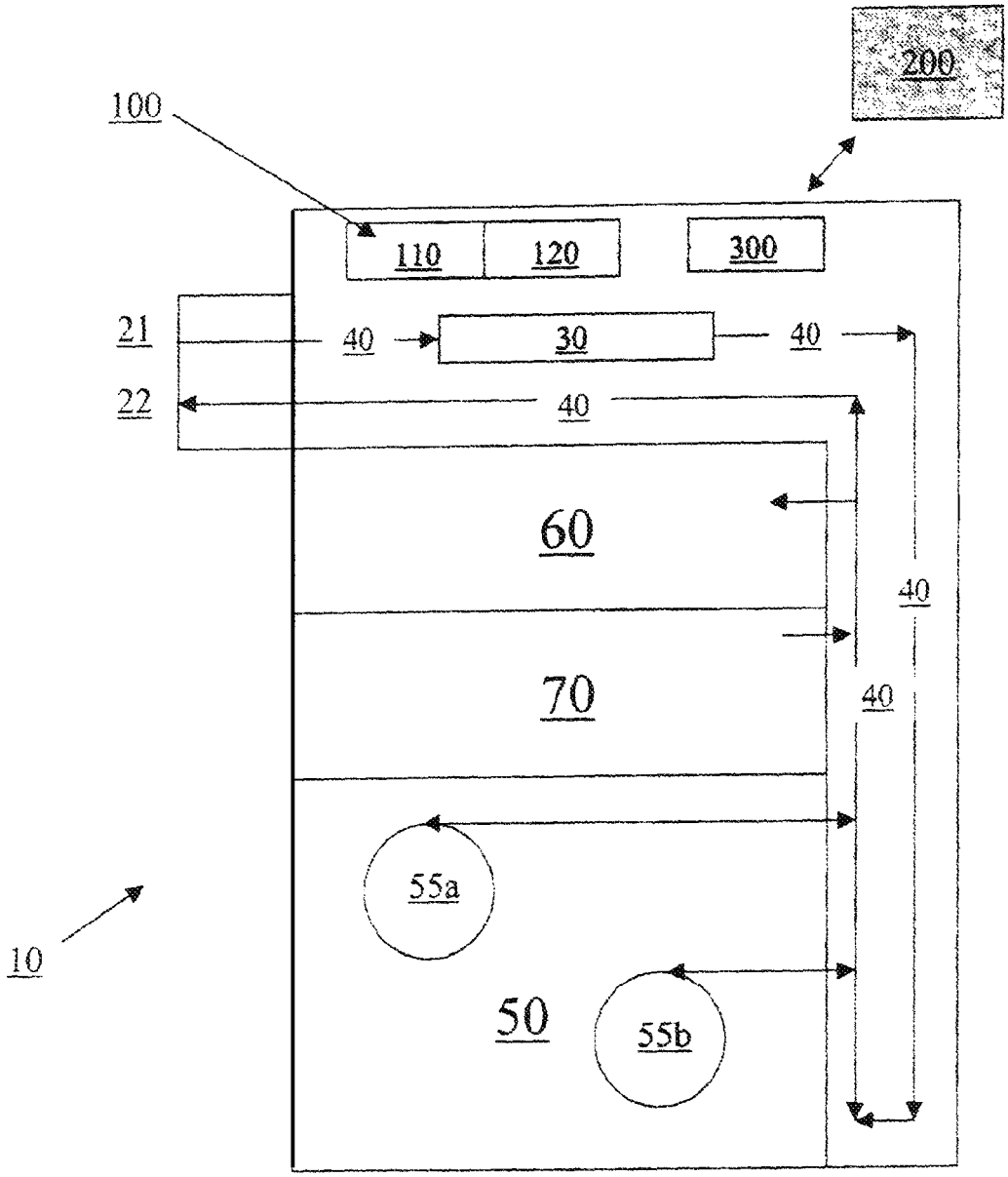
FIG. 20 illustrates a money handling apparatus including a communications unit.

Once service coupon 800 is stored temporarily on storage drum 555*a*, the money handling device operates to cause CLASS 2 currency items to be dispensed from storage drum 555*b* to cashbox 560 via transportation mechanism 540. In the pervious example of twenty banknotes (see Table 2), there is more than one class of currency items stored on storage drum 555*b*. Any currency items residing on drum 555*b* must be moved temporarily from drum 555*b* to allow the CLASS 2 currency item to be dispensed from storage drum 555*b* to cashbox 560 via transportation mechanism 540. In the current example, the CLASS 3 and CLASS 4 currency items are transferred temporarily from storage drum 555*b* to storage drum 555*a* as previously described. Once all CLASS 2 currency items have been transferred to cashbox 560, the CLASS 3 and CLASS 4 currency items stored temporarily on storage drum 555*a* are returned to storage drum 555*b*, thus allowing service coupon 800 to be dispensed from storage drum 555*a* to cashbox 560 via transportation mechanism 540. The foregoing sequence of operations can be repeated as necessary for each additional service media received by the device 500 from the service person to have the corresponding currency items transferred to cashbox 560. FIG. 16 shows the result of a service person inserting the following service coupons into money handling device 500.

TABLE 3

| Example: Service Coupons inserted to stack currency items in cashbox in FIG. 16 |
|---|
| Service Coupon 700 - CLASS 1 currency items |
| Service Coupon 800 - CLASS 2 currency items |
| Service Coupon 900 - CLASS 3 currency items |
| Service Coupon 1000 - CLASS 4 currency items |
| Service Coupon 1100 - CLASS 5 currency items |

In an example, multiple service coupons (or identifiable media) recognizable by money handling unit 10 are inserted therein to cause the transfer of corresponding currency items to be received by cashbox 60 in a sequential manner. In some implementations each inserted currency class is separated within cashbox 60 via the corresponding service coupon as shown in FIG. 16. In some implementations, all service coupons (e.g., 700, 800, 900, 1000, 1100) can be inserted into money handling unit 10 at the same time. Inserting a bundle of service coupons into money handling unit 10 facilitates transferring all corresponding currency items to cashbox 560 according to a predetermined sequence.

A particular service coupon can, in some cases, correspond to more than one currency class based on the desired operation and configuration of money handling unit 10. Specifically, money handling unit 10 can be arranged to receive a single service media (e.g., service coupon or instruction from an external component) whereby the money handling unit transports one or more stored currency items to cashbox 60 in a predetermined order or sequence.

In some implementations, an external component (e.g., a remote service center) can communicate with money handling unit 10 via a wireless or other network to provide a service media (e.g., storing operational instructions) to cause currency items stored in the unit to be transported to cashbox 60 in a predetermined sequence. In some implementations, control unit 100 is arranged to monitor and store in memory 120 at least the position and classification of each item of currency stored within money handling unit 10. Money handling unit 10 can be configured such that the contents and relative position of items stored within cashbox 60 are communicated to an external component 200. In some implementations, cashbox 60 contains a memory unit for receiving (from money handling unit 10) data corresponding to the cashbox contents and for storing the data in the memory unit.

Other implementations are within the scope of the claims.

What is claimed is:

1. A money handling apparatus for dispensing items of currency and accepting at least one service media comprising:

an authentication unit to classify received items of currency;

at least one first storage unit coupled to the money handling apparatus to dispense items of received currency;

a transportation mechanism to transport items of received currency to and from the at least one first storage unit;

a removable storage unit to receive at least one item of received currency stored in the at least one first storage unit;

the authentication unit having a mechanism for recognizing the at least one service media presented to the money handling apparatus as corresponding to a particular class of currency items capable of being stored by the at least one first storage unit; and, the transportation mechanism structured and arranged to transfer at least one item of currency, when present in the at least one first storage unit, to the removable storage unit when the item of currency belongs to the particular class corresponding to the at least one service media.

2. The money handling apparatus according to claim 1 wherein the at least one storage unit comprises a storage drum.

3. The money handling apparatus according to claim 1 wherein the at least one storage unit comprising at least two storage drums.

4. The money handling apparatus according to claim 3 wherein the at least two storage drums are configured to store different quantities of currency items.

5. The money handling apparatus according to claim 1 further comprising a control unit to control operation of the money handling apparatus.

6. The money handling apparatus according to claim 5 wherein the control unit is arranged to store characterization information for at least one class of currency item.

7. The money handling apparatus according to claim 5 wherein the control unit is arranged to store characterization information for at least one service media.

8. The money handling unit according to claim 5 wherein the control unit is arranged to recognize at least one service media.

9. The money handling unit according to claim 8 wherein the service media is a coupon received by the authentication unit.

10. The money handling apparatus according to claim 9 wherein the authentication unit is arranged to characterize at least one service media.

11. The money handling apparatus according to claim 1 further comprising a communications unit.

12. The money handling apparatus according to claim 11 wherein the communications unit is arranged for wireless communication with a component external to the money handling apparatus.

13. The money handling apparatus according to claim 12 arranged to receive a service media via a wireless communication from a remote network.

14. The money handling apparatus according to claim 1 wherein the service media is a coupon inserted into the money handling apparatus.

15. The money handling apparatus according to claim 11 wherein the service media is received by the communications unit from an external component.

* * * * *